United States Patent [19]

Young et al.

[11] Patent Number: 4,547,109

[45] Date of Patent: Oct. 15, 1985

[54] DRILL PIPE HANDLING AND PLACEMENT APPARATUS

[76] Inventors: Horace J. Young, #2402, 924 - 7th Ave. SW., Calgary, Alberta, Canada, T2P 1A4; Robert F. Becker, 327 Silver Valley Rise NW., Calgary, Alberta, Canada, T3B 4B1; Brian C. Will, P.O. Box 48, Site 17, R.R. #2, Calgary, Alberta, Canada, T2P 2G5

[21] Appl. No.: 502,088

[22] Filed: Jun. 8, 1983

[51] Int. Cl.[4] ..... E21B 19/14; E21B 19/20

[52] U.S. Cl. ..... 414/22; 175/85; 294/81.62; 294/103.1; 414/736; 414/745

[58] Field of Search ..... 414/4, 22, 741, 745, 414/735, 776, 736; 175/52, 85; 166/85; 294/67 BB, 86 R, 103 R; 901/37, 38, 15

[56] References Cited

U.S. PATENT DOCUMENTS

| | | | |
|---|---|---|---|
| 1,518,561 | 12/1924 | Carroll | 414/621 |
| 3,177,944 | 4/1965 | Knights | 414/22 X |
| 3,181,630 | 5/1965 | Coburn | 175/85 |
| 3,581,506 | 6/1971 | Howard | 175/85 X |
| 3,750,769 | 8/1973 | Young et al. | 175/85 |
| 3,937,514 | 2/1976 | Langowski | 414/22 X |
| 4,403,897 | 9/1983 | Willis | 294/86 R X |
| 4,423,998 | 1/1984 | Inaba et al. | 294/86 R X |
| 4,459,898 | 7/1984 | Harjar et al. | 414/4 X |

*Primary Examiner*—Leslie J. Paperner
*Assistant Examiner*—Lyle Kim
*Attorney, Agent, or Firm*—Shlesinger, Arkwright, Garvey & Fado

[57] ABSTRACT

A cylindrical goods lifting and placement apparatus comprises a platform, an angularly disposable frame pivotably connected to the platform and having a drill pipe holding system for holding a length of drill pipe. An angularly displaceable member is pivotably connected to the platform and has a cylinder and piston assembly for angularly displacing the member from a first position substantially adjacent the holding system. Drill pipe grippers are connected to the member and the grippers are rotatable on an axis from a first position to a second position substantially aligned with the holding system. A drive system for rotating the pipe grippers is provided. Similarly, a drive system for operating the grippers is provided.

19 Claims, 10 Drawing Figures

FIG 5
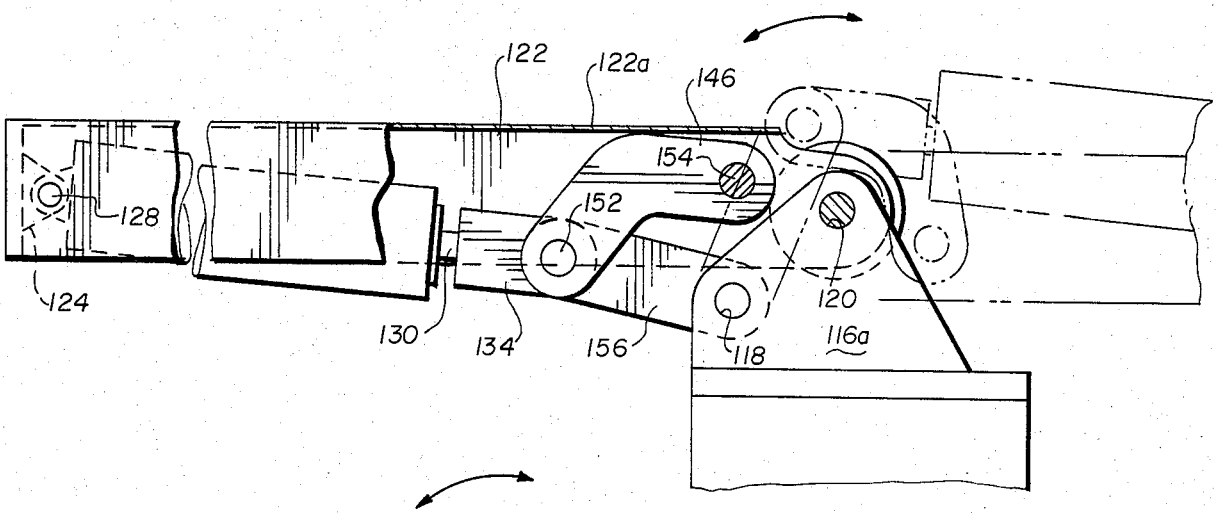
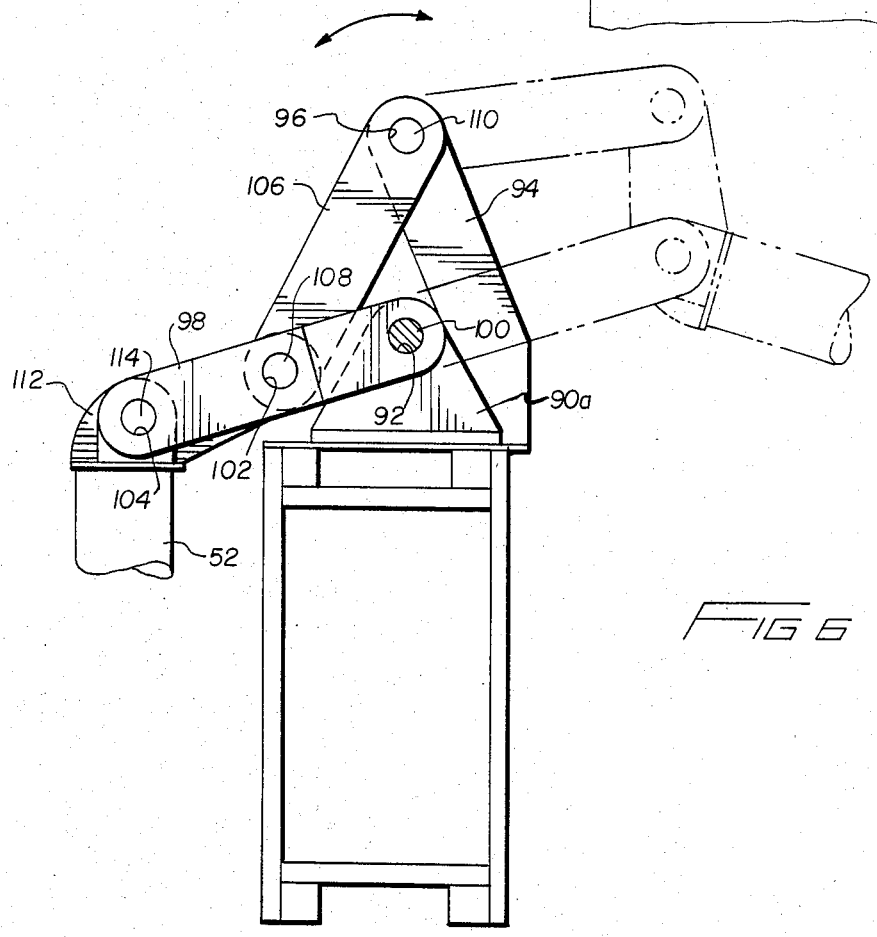
FIG 6

DRILL PIPE HANDLING AND PLACEMENT APPARATUS

BACKGROUND OF THE INVENTION

As the search for oil and gas has increased, so also have the various types of drilling rigs increased. One particularly advantageous type of drilling rig is that which is capable of drilling at any angle from the horizontal to the vertical. Such slant-type drilling rigs are advantageous in that the bore hole may be drilled at almost any angle.

While slant-type drilling rigs are advantageous in permitting drilling at any angle, they are disadvantageous in that the means for lifting the drill pipe into the drilling position are very cumbersome. Conventional vertical drilling rigs employ a draw-works system to lift the drill pipe and place it in vertical alignment with the bore hole. Such a draw-works type system is not possible with a slant-type drilling system as the drill pipe must be angularly aligned with the bore hole and, hence, a draw-works system is not readily usable as the draw-works is displaceable co-axially with the bore hole.

An additional disadvantage of a slant-type drill rig is that means must be provided for supporting the drill pipe along its length which means do not interfere with the operation of the rotary spindle or table which is used to turn the drill pipe and the drill bit. Conventional vertical drill rigs do not require support means for the drill pipe as the length of drill pipe is supported in the bore hole and is aligned vertically with the spindle and, hence, has no horizontal component.

Consequently, a new and unique system for lifting 1 drill pipe from a horizontal storage position to an angular position associated with a slant-type drilling rig is advantageous. Such a system must be capable of placing the drill pipe in mounts for supporting the drill pipe along its length during the drilling operation. Such support mounts must not interfere with the operation of the rotary spindle during its traverse along the length of the drill rig.

SUMMARY OF THE INVENTION

It is a primary object of the disclosed invention to provide an angularly displaceable drill pipe lifting and placement apparatus which is adapted for relocating a length of drill pipe from a first pre-determined position to a second pre-determined position.

Another object of the disclosed invention to provide displaceable drill pipe supports associated with a slant-type drilling rig frame.

Still another object of the disclosed invention is to provide a drill pipe lifting and placement apparatus which is connected to the drilling platform and which is pivotable therewith into association with the slant-type drilling rig frame.

Yet another object of the disclosed invention is to provide drill pipe support means which are adapted for preventing the unintended displacement of a length of drill pipe.

Yet still another object of the disclosed invention is to provide a drill pipe lifting and placement apparatus having a pair of cooperating gripper jaws.

Still yet another object of the disclosed invention is to provide a drill pipe lifting and placement apparatus which is angularly displaceable between the horizontal and the vertical.

Yet a further object of the disclosed invention is to provide a drill pipe lifting and placement apparatus which is relatively simple to construct and which is capable of remote operation.

Yet an additional object of the disclosed invention is to provide a drill pipe lifting and placement apparatus which is capable of lifting drill pipe from a horizontal storage bin.

Still yet a further object of the disclosed invention is to provide a drill pipe lifting and placement apparatus which is adapted for removing a length of drill pipe from a slant-type drilling rig and lowering the length of drill pipe into a horizontal drill pipe supply bin.

Yet still a further object of the disclosed invention is to provide drill pipe support means which do not interfere with the operation of the slant-type rig rotary spindle.

These and other objects and advantages of the invention will be readily apparent in view of the following description and drawings of the above-described invention.

DESCRIPTION OF THE DRAWINGS

The above and other objects and advantages and novel features of the present invention will become apparent from the following detailed description of the preferred embodiment of the invention illustrated in the accompanying drawings, where:

FIG. 5 is a fragmentary cross-sectional view taken along the Section 5—5 of FIG. 3 and with portions shown in phantom, and with arrows indicating displacement;

FIG. 6 is a fragmentary side elevational view of the pivot mechanism of FIG. 3 shown in the normal position with arrows indicating rotation and with portions shown in phantom;

DESCRIPTION OF THE INVENTION

Figure 1:
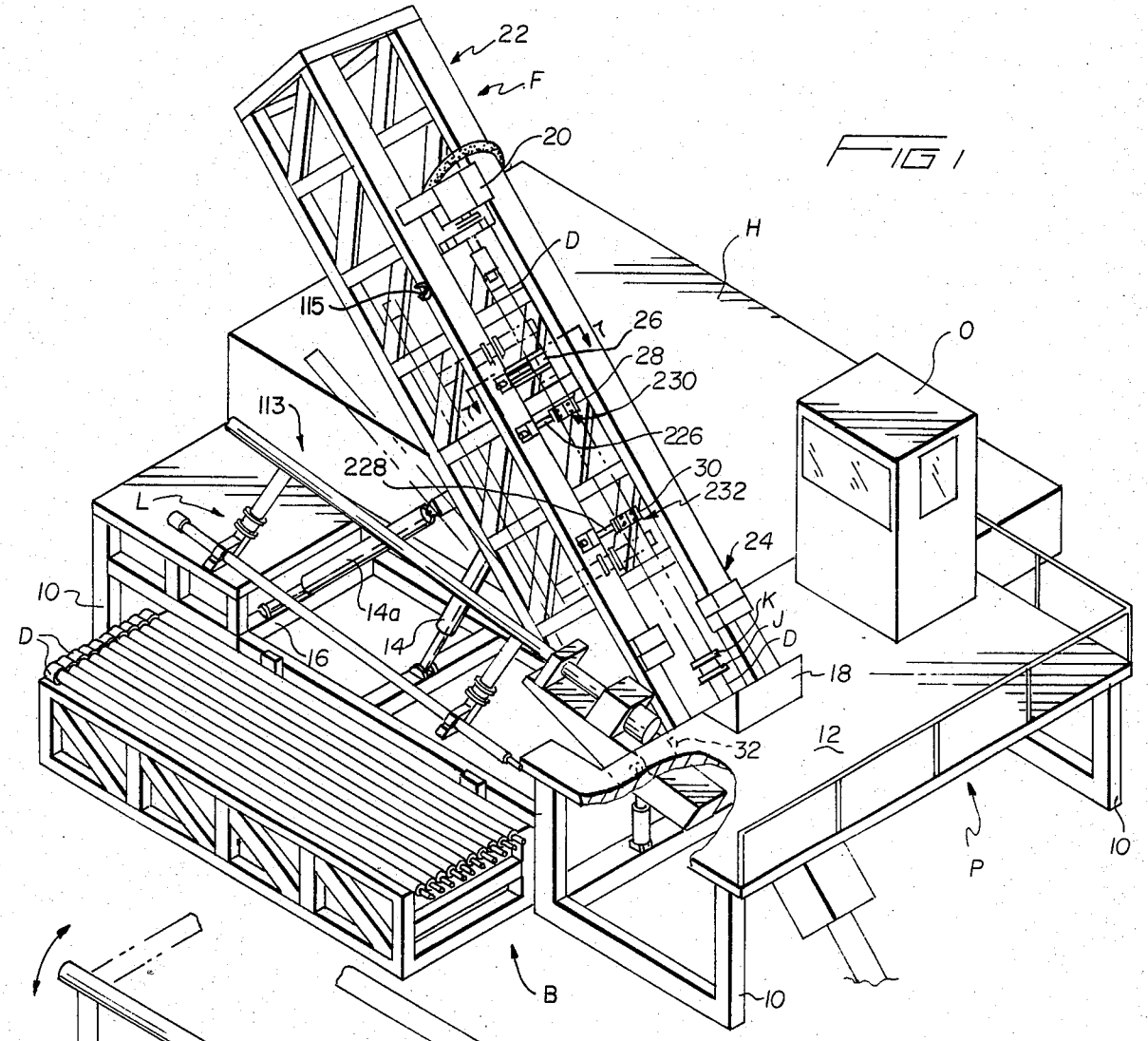
FIG. 1 is a perspective view, with portions broken away, of a slant-type drilling rig and with the drill pipe lifting and placement apparatus shown and with portions shown in phantom.

A ground supported drilling platform P, as best shown in FIG. 1, has a plurality of legs 10 and a flat horizontal flooring section 12 attached thereto. Normally provided is an operator's shed or booth O on or near platform P. Preferably, platform P will be provided with at least one drilling mud supply housing H located adjacent platform P. A drill pipe supply bin B adapted for holding a plurality of lengths of drill pipe D in a horizontal position is preferably located adjacent platform P on the side opposite drilling mud housing H. Bin B is adapted for supplying the lengths of drill pipe D or for receiving the lengths of drill pipe D.

Platform P is provided with an angularly disposable drilling rig frame F which is displaceable from the horizontal to the vertical by means of cylinder 14 which is secured at one end to the underframe 16 of the platform P and on the other end to the drilling rig frame F. Cylinder 14 is adapted for reciprocatingly disposing frame F from the horizontal to the vertical. An extendable member 14(*a*), commonly referred to as a "stiff leg", is utilized following positioning of the frame F by cylinder 14. Once frame F is angularly located, member 14(*a*) is locked into position and provides full support for frame F. A drill pipe guide box 18 is angularly displaceable with, and connected to, rig or frame F and is adapted for guiding a length of drill pipe D. The rig includes a rotary spindle 20 which is axially displaceable along the length of the rig and which is adapted for rotating a length of drill pipe D and the associated drill bit (not shown). Rotary spindle 20 advances from the upper end of 22 of frame F to the lower end 24 of frame F and is adapted for applying pressure to the length of drill pipe D for causing drill pipe D to descend into the earth or the material to be drilled. Frame F includes pipe support means 28 and 30 which are adapted for supporting the length of drill pipe D as the rotary spindle 20 advances from upper end 22 to lower end 24. Pipe supports 28 and 30 are adapted for reciprocating displacement transverse of the rotary axis of drill pipe D and rotary spindle 20 so as not to interfere with the traverse of rotary spindle 20 from upper end 22 to lower end 24, as will be explained herein later. Pipe support 26 is provided to initially hold pipe D, thus preventing the pipe from sliding down towards the hole, and secondly to prevent rotation when the joint between spindle 20 and pipe D is being made or broken.

Pipe lifting and placement means L is pivotably connected to either the underside or topside of flooring 12 by pin 32 cooperating with a bracket, (not shown) as is well known in the art. Lifting means L is positioned adjacent frame F and is adapted for angular displacement from a substantially first horizontal position to a second position substantially parallel to and adjacent to frame F. Lifting means L is uniquely adapted for gripping a length of drill pipe D and placing that length of drill pipe D onto pipe supports 26, 28 and 30. Lifting means L is also adapted for lifting the length of drill pipe D from pipe supports 26, 28 and 30 and placing it into position in pipe bin B. It can be appreciated, therefore, that spindle 20 and guide box 18 provide frame F with a longitudinal drilling frame axis.

Figure 2:
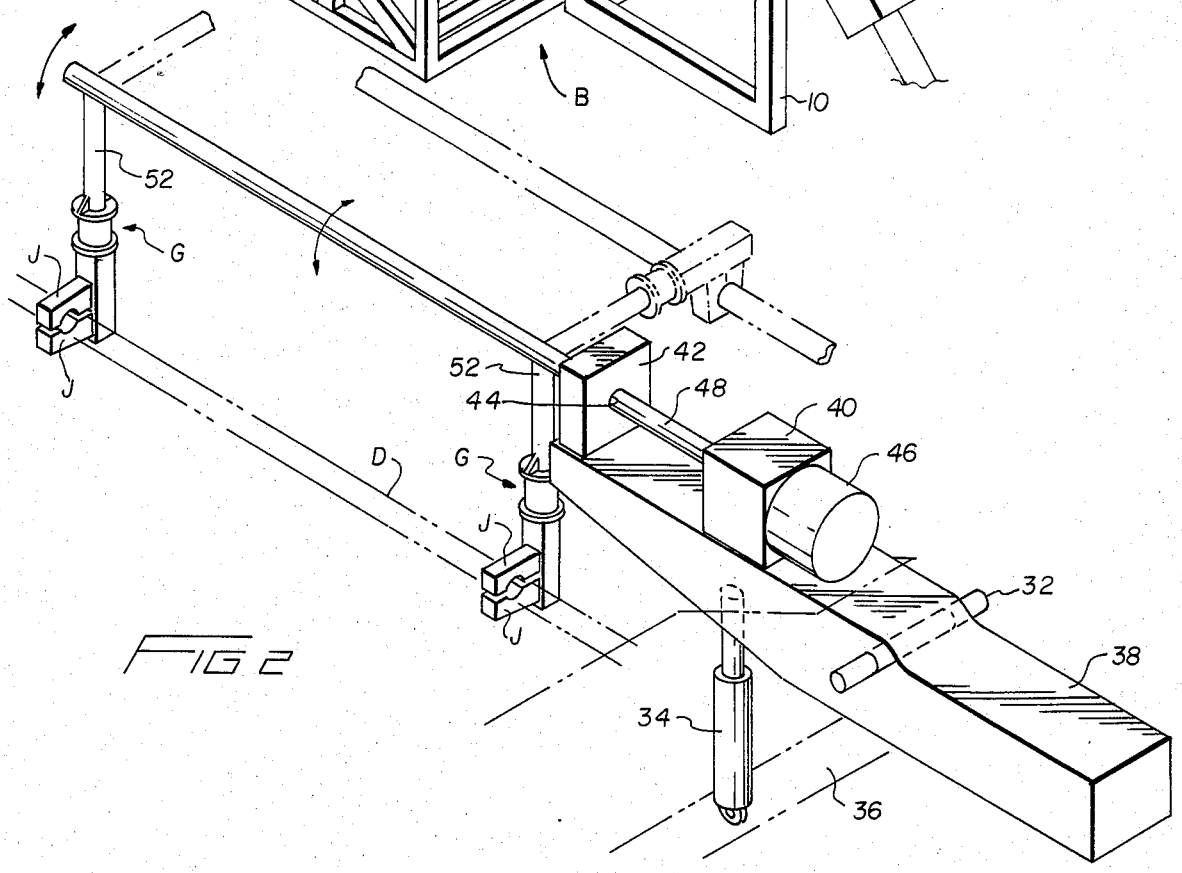
FIG. 2 is an enlarged fragmentary perspective view of the drill pipe lifting and placement apparatus of FIG. 1 and with portions shown in phantom and arrows indicating rotation and angular displacement.

As best shown in FIG. 2, cylinder and piston means 34 is pivotable secured on the one end to under frame 36 and on the other end to counterweight 38 of lifting means L. Cylinder 34 is adapted for angularly displacing lifting means L from a substantially horizontal position to a position parallel to and aligned with adjacent frame F.

Bearing blocks 40 and 42 are secured to counterweight 38 on its upper surface and bearing block 42 has an aperture 44 and circumferential bearings (not shown). Motor means 46 has a shaft (not shown) axially aligned with aperture 44. A rotatable shaft 48 is connected to the rotatable shaft of motor means 46 and extends through aperture 44 of bearing block 42 and a substantial distance therefrom. Preferably, bearing block 40 contains a gear reducer (not shown) which is adapted for permitting the rotating shaft (not shown) of motor means 46 to turn freely while shaft 48, preferable, rotates 270°, although a greater or lesser rotation is obtainable.

Holding means 115 is provided on frame F and is adapted to receive and provide support for rotatable shaft 48 when shaft 48 is in its upper operable position, adjacent and parallel to frame F. End 113 of shaft 48, when in the upper position, is journaled within 115 to permit rotation of shaft 48 when in supporting engagement with holding means 115.

Figures 3, 4:
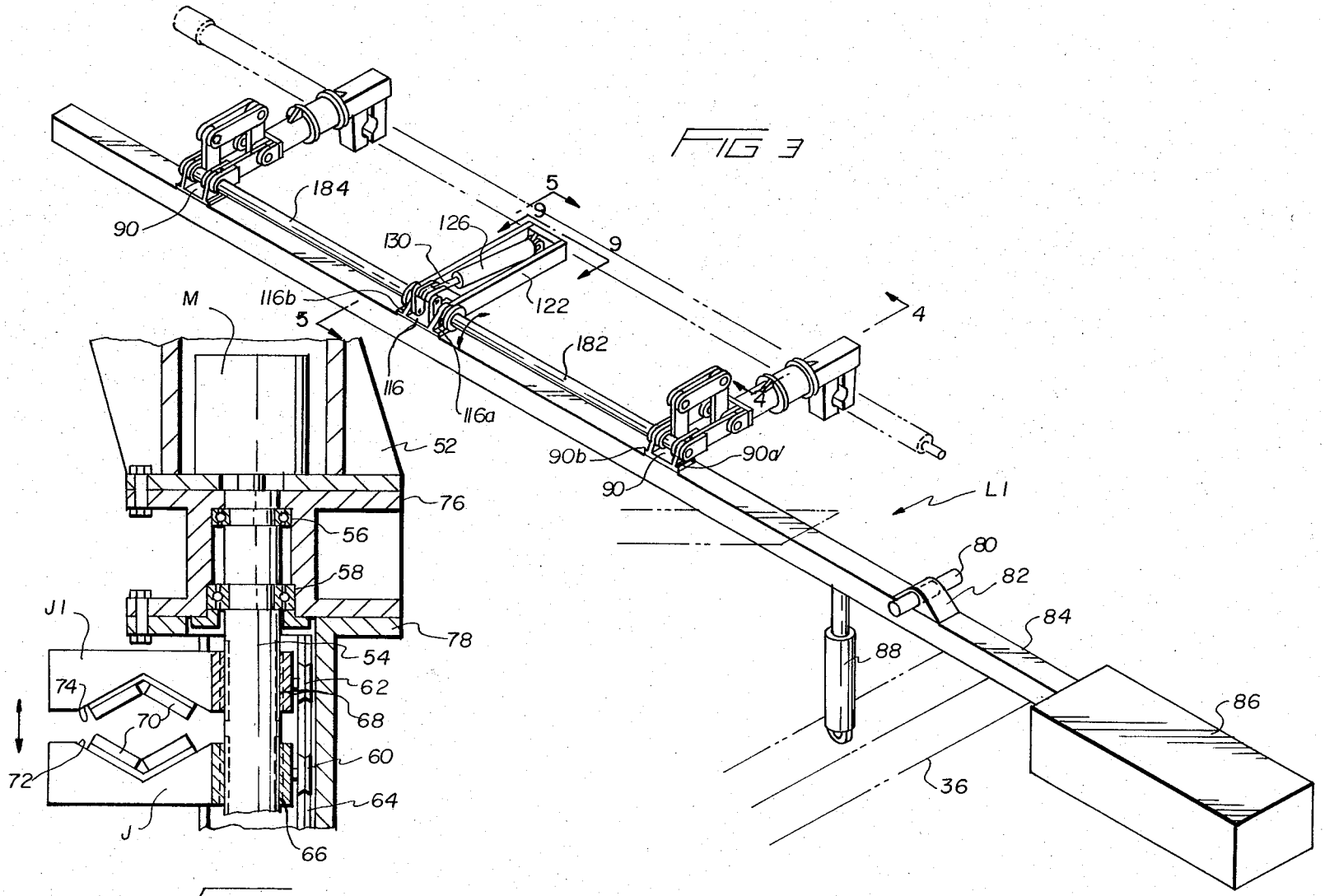
FIG. 3 is a fragmentary perspective view of another embodiment of the drill pipe lifting and placement apparatus of FIG. 1, with portions shown in phantom and with arrows indicating rotation and angular displacement.
FIG. 4 is a fragmentary cross-sectional view taken along the Section 4—4 of FIG. 3 and with arrows indicating displacement.
Figure 8:
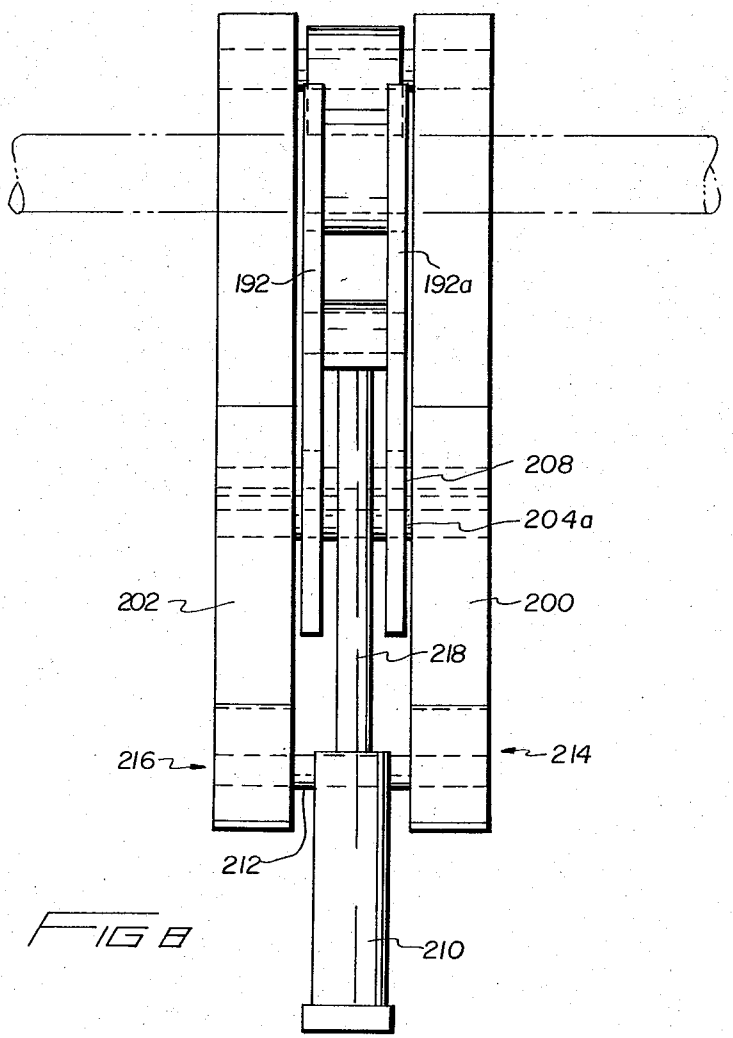
FIG. 8 is a fragmentary side elevational view taken along the Section 8—8 of FIG. 7 with portions shown in phantom.

A pair of gripping means G are connected to shaft 48 transverse of its axis of rotation and are uniquely adapted for gripping and releasing a length of drill pipe D. Gripping means G include spaced extensions 52 secured to shaft 48 and extending transversely therefrom. Electric motor means M, as best shown in FIG. 4, are mounted in extensions 52. As best shown in FIG. 4, in this particularly described embodiment, motor means M is adapted for rotating threaded shaft 54. Bearings 56 and 58 surround shaft 54 and are spaced from motor M. A pair of opposed pipe jaws J and J1 are mounted on shaft 54 and have guide or wheel means 60 and 62 adapted for following track 64. Preferably, jaws J and J1 have threaded apertures 66 and 68, respectively, which are adapted so that the rotation of shaft 54 by motor means M causes jaws J and J1 to advance toward or away from each other, depending upon the rotation of shaft 54, so as to grip or release a length of drill pipe D. Preferably, threaded apertures 66 and 68 have their thread orientations opposed from each other so that rotation of shaft 54 by motor means M in one direction will cause jaws J and J1 to approach each other and, when the rotational direction is changed, jaws J and J1 will move away from each other. It should be obvious, that the opposed orientation of the threads of threaded apertures 66 and 68 could be readily accomplished by means of threaded shaft 54 having the opposed orientation while threaded apertures 66 and 68 could, then, have the same thread orientation. Preferably, jaws J and J1 will have pipe gripping pads 70 so to protect the opposed gripping surfaces 72 and 74, respectively.

Preferably, bearings 56 and 58 will be contained in bearing housing 76 which is bolted, or otherwise secured, to extensions 52 on the one end and on the other end to jaw block 78 to which is mounted jaws J and J1.

In the preferred embodiments, as disclosed above, displacement of the jaws J and J1 is effected by means of the threaded shaft 54, however, it will be accepted that the displacement of the jaws can be affected by other means, for example a hydraulic cylinder operatingly committed with each jaw member, to effect displacement thereof between an open and closed (pipe gripping) position.

In operation, lifting means L is, normally, in a first substantially horizontal position with gripper means G adjacent a length of drill pipe D positioned horizontally in pipe bin B. Jaws J and J1 are initially open to receive the length of drill pipe D and are then closed by means of motor means M acting through rotating shaft 54 so to grip the length of drill pipe D between opposed gripping jaws J and J1 and thereby provide a loading axis for lifting means L. Drilling rig frame F is, preferably, angularly disposed relative to platform P and rotary spindle 20 is in the area of upper end 22 and pipe supports 26, 28 and 30 are displaced upwardly and substantially aligned with the axis of drill pipe D and rotary spindle 20. Cylinder 34 is then extended so as to cause shaft 48 to be displaced angularly upwardly so to be aligned, with and to with frame F. The loading axis of lifting means L is thereby free to be aligned with the drilling frame axis, as will be described.

After shaft 48 is aligned with frame F, motor means 46 rotates shaft 48 substantially 270° which causes gripping means G on extensions 52 to be rotatingly displaced so that the length of gripped drill pipe D is then placed onto pipe supports 26, 28 and 30. After the length of drill pipe D is placed on pipe supports 26, 28 and 30, the upper grips on support 26 are closed to secure the pipe before opposed jaws J and J1 release the length of drill pipe D. Once the upper grips on support 26 have been actuated and are holding the pipe, both jaws open and can retract, leaving the length of the pipe D supported by pipe supports 26, 28 and 30. Shaft 48 is rotated substantially 270° into its initial position and cylinder 34 is retracted so that lifting means L is substantially horizontal and grippers G are again adjacent pipe bin B and ready to receive an additional length of drill pipe D.

It should be appreciated, that should it be necessary to remove a length of drill pipe D from frame F, then lifting means L would be displaced angularly upwardly by cylinder 34 and shaft 48 rotated so that grippers G are adjacent a length of drill pipe D and jaws J and J1 are open and ready to grip a length of drill pipe. At this point jaws J and J1 would be closed so as to grip the length of drill pipe D and the shaft 48 would be rotated and cylinder 34 retracted so that the length of drill pipe D could be placed into storage bin B.

In the embodiment shown in FIG. 3, a drill pipe lifting and placement apparatus L1 is pivotably mounted to the underside of flooring 12 by means of pin 80 rotatingly mounted in holder 82 and secured to angularly displaceable member of shaft 84. Pin 80 cooperates with a bracket (not shown) secured to the underside of flooring section 12 by means well known in the art. A counterweight 86 is affixed to one end of shaft 84 and shaft 84 extends longitudinally a considerable distance from counterweight 86. A cylinder 88 is pivotably connected on one end to under-frame 36 of platform P and on its other end to shaft 84. Cylinder 88 is adapted for reciprocating angular displacement of shaft 84.

A pair of gripper means mounts 90 are secured to the upper surface of shaft 84 and each gripper means mounts has a pair of spaced pivot brackets or parallel members **90*a* and 90*b* extending upwardly and each member 90*a* and 90*b* has a co-axial aperture 92, best shown in FIG. 6. A second member 94 is secured to and extends upwardly above gripper means mount 90 and is positioned between the members 90*a* and 90*b* and has an aperture 96. A pair of links 98 are rotatingly mounted to mount 90, at members 90*a* and 90*b*, by pin means 100 and have second and third co-axial apertures 102 and 104, respectively. A second link 106 is connected by pins 108 and 110 to apertures 102 and 96 respectively. Link 106 is rotatable on an axis corresponding to pin 110. Extension 52 has a link 112 fastened to one end which is rotatably connected to links 98 and 106 by means of pins 108 and 114. Extension 52** and gripper G are of the type previously described and the operation of gripper jaws J and J1 is accomplished in the same manner.

Cylinder mount 116, as best shown in FIGS. 3 and 5, is affixed to the upper surface of shaft 84 and has two upstanding spaced parallel members **116*a* and 116*b* are of generally triangular shape and each of the members 116*a* and 116*b* has coaxial apertures 118 and 120. Cylinder mount 116 is disposed midway between mounts 90 and apertures 120 are co-axial with apertures 92 of mounts 90**.

Figure 10:
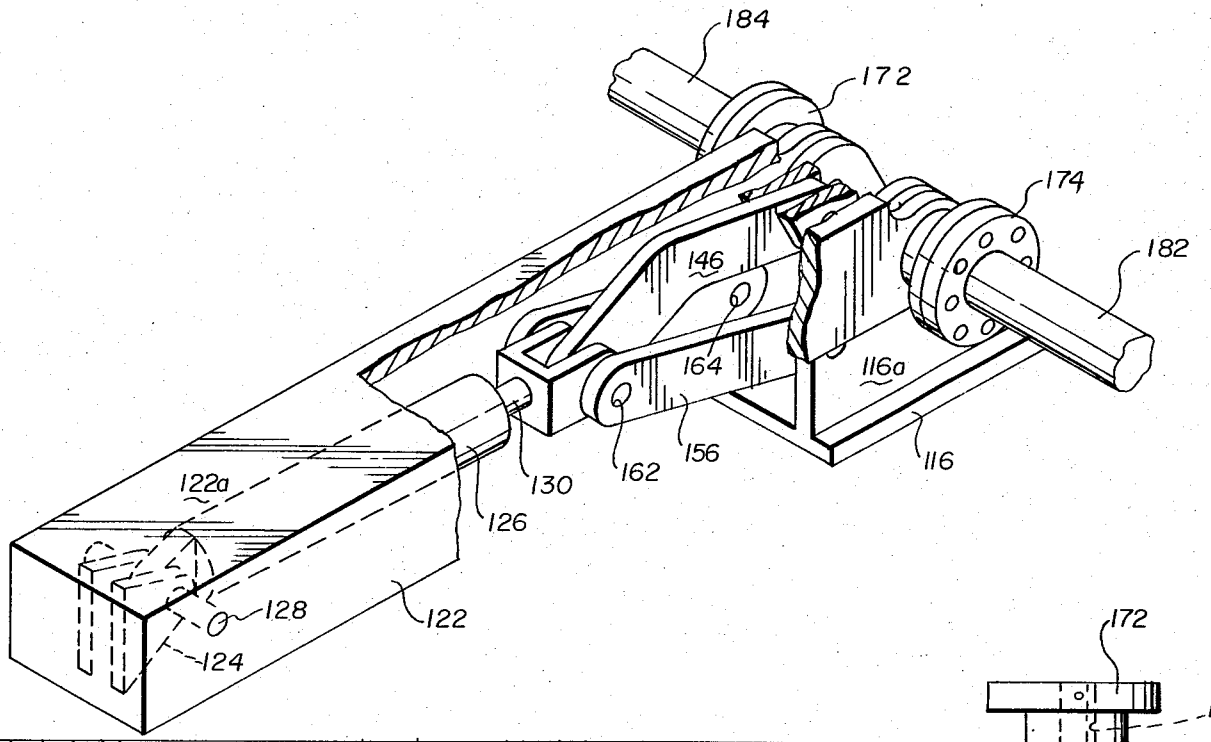

A cylinder bracket 122, as best shown in FIGS. 5 and 10, is a substantially open ended box-type structure which has a cylinder mount 124 which is adapted for pivotably securing one end of cylinder 126 by pin means 128. Cylinder mount 124 is secured to bracket 122. Piston 130 of cylinder 126 has a clevis 132 secured to its outer most end.

Figure 9:
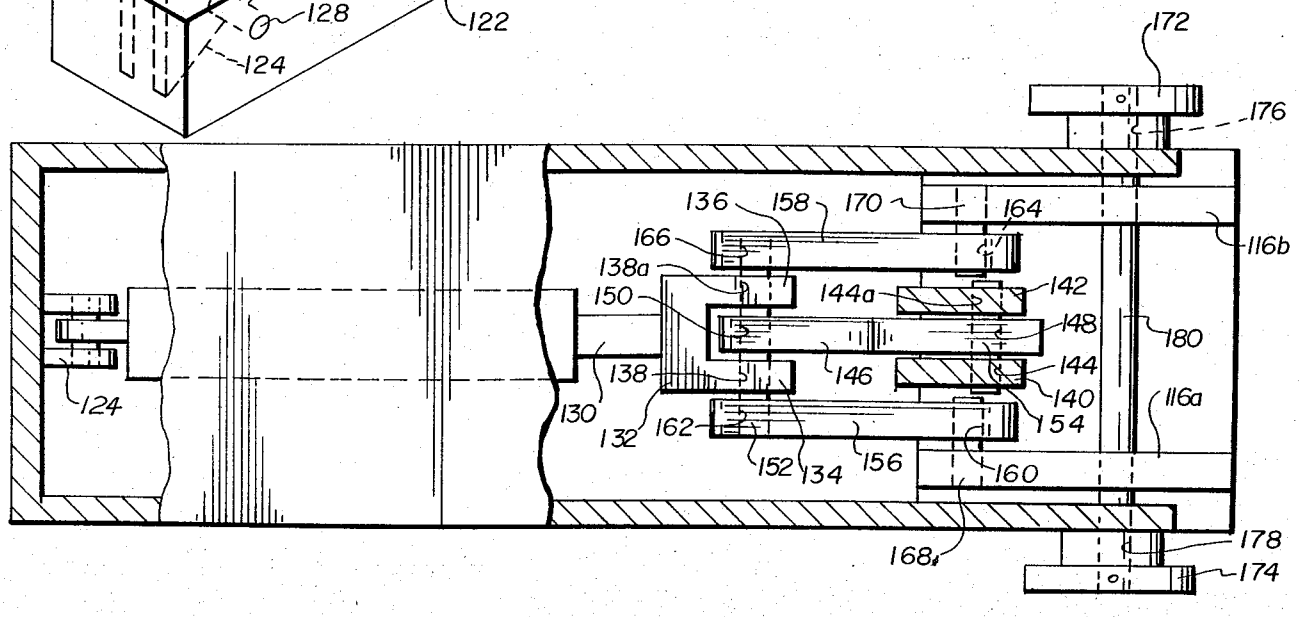
FIG. 9 is a fragmentary cross-sectional view taken along the Section 9—9 of FIG. 3; and, FIG. 10 is a fragmentary perspective view of FIG. 9.

Clevis 132, as best shown in FIG. 9, has two spaced parallel ears 134 and 136 with co-axial apertures 138 and **138*a*. Cylinder bracket 122 has cooperating cylinder bracket ears 140 and 142 which are maintained in a spaced parallel relationship and have cooperating co-axial apertures 144 and 144*a*. Ears 140 and 142 are spaced on the opposite side of bracket 122 from cylinder mount 124** at substantially the end thereof.

Contoured link 146 with a substantially boomerang-type shape has apertures 148 and 150 which are aligned with aperture 138 and **138*a* and 144 and 144*a*, respectively, and which is rotatably secured by pins 152 and 154, respectively. Pin 152 extends outwardly beyond ears 134 and 136, as best shown in FIG. 9, and contoured links 156 and 158 are pivotably mounted thereto. Link 156 has spaced apertures 160 and 162 and link 158 has spaced apertures 164 and 166. Link 156 is pinned to ear 134 by pin 152 passing through aperture 162. Aperture 160 is pinned by pin 168 to aperture 118 of support 116*a*. Link 158 is pinned to ear 136 by pin 152 cooperating with aperture 166 and to member 116*b* by pin 170 cooperating with apertures 118 and 164. In this way, contoured link 146 is free to rotate on pin 154, and links 156 and 158 are free to rotate on pins 168 and 170**, respectively.

As best shown in FIGS. 9 and 10, bracket 122 has coaxial spaced parallel flanges 172 and 174 and co-axial apertures 174 and 178 co-axial with flanges 172 and 174, respectively. Apertures 176 and 178 are pinned by pin 180 to apertures 120 of pivot brackets **116*a* and 116*b*. Rotatable shafts 182 and 184 extend from flanges 172 and 174, respectively, to gripper means mount 90. Shafts 182 and 184 are co-axial with apertures 92 and are keyed to links 98 so that rotation of shafts 182 and 184, respectively, will cause links 98** to rotate as well.

When bracket 122 is in the horizontal position with surface **122*a* disposed upwardly, as best shown in FIGS. 5 and 10, then grippers G extend downwardly and are in position to grip a length of drill pipe D. When lifting and placement apparatus L1 has been angularly pivoted upwardly into parallel alignment with frame F, piston 130 of cylinder 126 is extended and link 146 rotates on pin 154 of ears 140 and 142 and links 156 and 158 rotate on pins 168 and 170, respectively, of the upstanding members of pivot bracket 116 and which thereby causes cylinder bracket 122 to rotate on pin 180. This causes cylinder bracket 122 to flip into position shown in FIG. 3 and which, necessarily, causes grippers G to rotate likewise so that drill pipe D may be placed upon pipe support mounts 26, 28 and 30. Retraction of piston 130 of cylinder 126 has the opposite result and causes cylinder bracket 122 to flip into the position shown in FIG. 5 such that grippers G extend downwardly ready to grip another length of drill pipe. Grippers G rotate substantially 270° although, it should be obvious, that greater or lesser rotation may be obtained by varying the linkage arrangement and the piston stroke of piston 130**.

As best shown in FIG. 6, rotation of link 98 from the position shown in dark lines to the position shown in phantom lines is accomplished by rotation of shafts 182 and 184.

Figure 7:
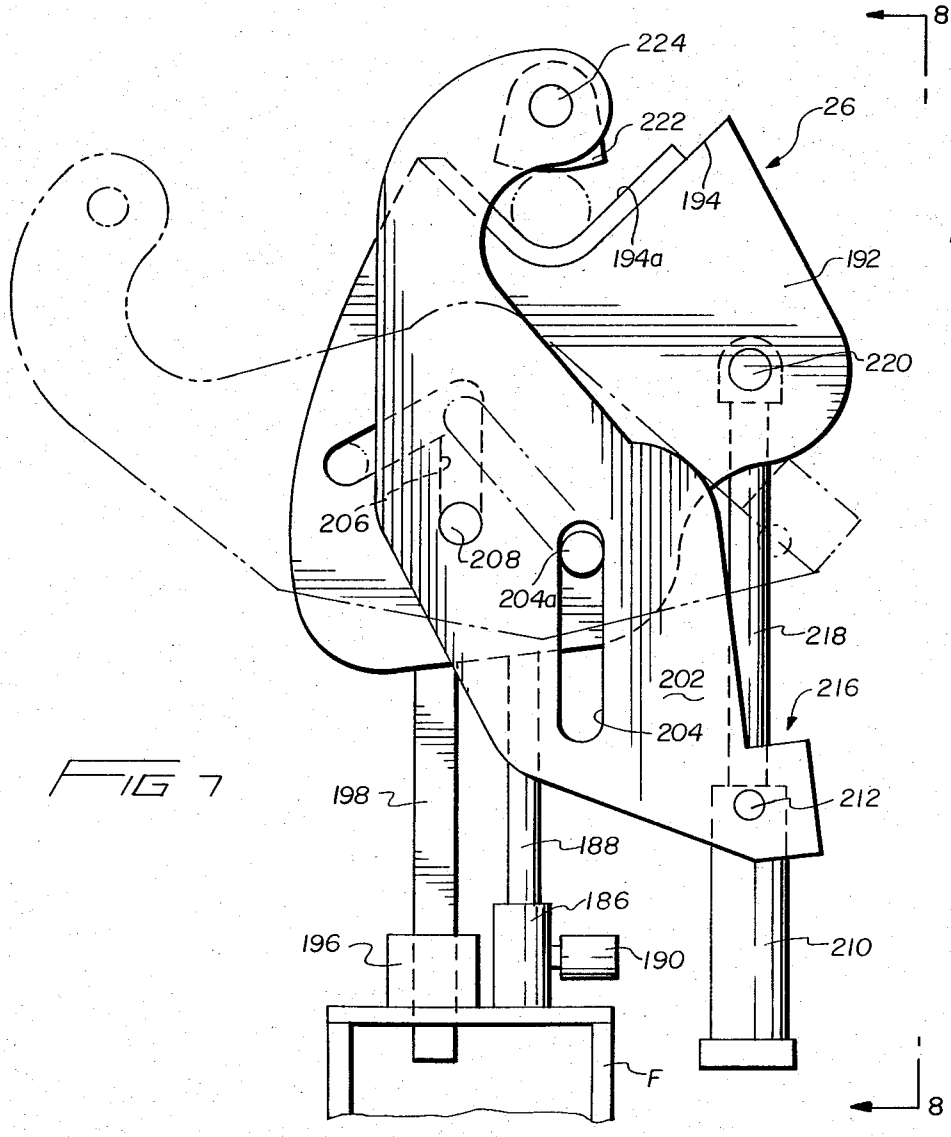
FIG. 7 is a fragmentary front elevational view taken along the Section 7—7 of FIG. 1 and with portions shown in phantom and indicating displacement.

As best shown in FIG. 7, pipe support 26 is displaceable on frame F by means of cylinder 186 and piston 188. Cylinder 186 includes control activator 190 which controls the displacement of piston 188 depending upon the size of the drill pipe to be handled. Piston 188 is connected at its upper end to spaced parallel pipe holding members 192 and 192*a*. Holding members 192 and 192*a* contain pipe support surfaces 194 and 194*a*, respectively. Guide block 196 is attached to frame F and includes follower 198 which is connected at its upper end to holding members 192 and 192*a* and which passes through an aperture in guide block 196 so as to support and guide holding members 192 and 192*a* as they are being displaced by piston 188 of cylinder 186.

Pipe jaws 200 and 202 are mounted on either side of holding members 192 and 192*a*. Jaws 200 and 202 each contain cooperating slots 204, of which only the slot in jaw 202 is shown, which penetrate through pipe jaws 202 and 204. Pin 204*a* is secured to holding members 192 and 192*a* and extends outwardly on either side thereof and engages slots 204 of pipe jaws 200 and 202. Holding members 192 and 192*a* also have cooperating channels 206, of which only one is shown in phantom in FIG. 7. Rotatable pin 208 extends inward from either side of jaws 200 and 202 and engages channels 206. Slots 204 and channels 206 serve to guide jaws 200 and 202 because pins 204*a* and 208 engage slots 204 and channels 206, respectively, to provide guiding support thereof.

The shape and direction of slots 204 and 206 with the respective rollers 204 and 208 cause jaws 200 and 202 to follow a path that allows grip point 222 to contact pipes D of various diameters, from large to small, in the same symmetrical relationship with two contact points on 194 and also in the retraction mode to follow a path that allows jaws 200 and 202 to move away from 194 and leave it open so that a pipe can be brought into it without interference from the jaws 200 and 202. This eliminates changing jaws for changes in pipe size, as is required on prior art tongs.

Cylinder 210 is connected to jaws 200 and 202 by pin 212 in the area of cylinder engaging portions 214 and 216. Cylinder 210 includes piston 218 which is fastened on its upper end to holding members 192 and 192*a* by pin 220. Cylinder 210 and piston 218 are displaceable with holding members 192 and 192*a* as holding members 192 and 192*a* are displaced by piston 188 of and cylinder 186.

When pipe support 26 is in position to secure a length of drill pipe D, piston 218 is retracted which causes cylinder 210 to approach holding members 192 and 192*a* which causes jaws 200 and 202 to pivot on pins 204*a* and 208 and to be guided into the open position shown in phantom lines in FIG. 7. The length of drill pipe D is placed onto pipe support surfaces 194 and 194*a* and piston 218 is extended which causes cylinder 210 to move away from holding member 192 which pivots pipe jaws 200 and 202 into the position shown in dark lines in FIG. 7 for grasping and securing the length of drill pipe D. Preferably, securing means 222 will be pivotable pinned to jaws 200 and 202 by pin 224 and will press the drill pipe D against pipe support surfaces 194 and 194*a*. In this way, a length of drill pipe D may be deposited on pipe supports 26, 28 and 30 by grippers G and the pipe D may be held in place by pipe support 26 so as to prevent unintended axial displacement of the length of drill pipe and also, as mentioned heretofore, prevents rotation of the pipe when the joint between the pipe and the drill string, or the pipe and the swivel, is being made-up or broken. Additionally, the length of drill pipe D may be secured into position prior to being removed from frame F by grippers G.

Pipe supports 28 and 30 have cylinders 226 and 228, respectively, as best shown in FIG. 1, which serve to displace pipe supports 28 and 30. Pipe supports 28 and 30 have V-shaped pipe engaging surfaces 230 and 232 which serve to axially guide a length of drill pipe D. Pipe engaging surfaces 230 and 232 may, preferably, contain bearings to facilitate displacement of the length of drill pipe D.

Pipe supports 26, 28 and 30 are displaceable to a position below the plane of the lower surface of rotary spindle 20 so that as rotary spindle 20 approaches pipe supports 26, 28 and 30 the pipe supports 26, 28 and 30 may be displaced downwardly individually so as not to interfere with the axial movement of rotary spindle 20. In this way the length of drill pipe D may be supported along its length while drilling progresses. Pipe supports 26, 28 and 30 are displaced downwardly individually out of the path of rotary spindle 20. Rotary spindle 20 will maintain the length of drill pipe at the proper elevation with the assistance of the pipe supports 26, 28 and 30. In the pipe receiving mode, pipe supports 26, 28 and 30 will be displaced upwardly so as to grasp and support the length of drill pipe when placed there by grippers G.

Finally, with reference to FIG. 1, two additional (conventional) tongs are provided shown here schematically and given reference letters K & J respectively. Tong J would grip the lower pipe D to prevent the drill string from turning when swivel 20 is making up the joint. The other tong K is preferably of the rotatable type, and would grip the upper section of pipe D that is being inserted. Additionally tong K can be utilized to break the joint between pipes in the event that power swivel 20 does not have sufficient power to do so in the normal manner.

While this invention has been described as having a preferred design, it is understood that it is capable of further modifications uses and/or adaptations of the invention following in general the principle of the invention and including such departures from the present disclosure as come within known or customary practice in the art to which the invention pertains, and as may be applied to the central features hereinbefore set forth, and fall within the scope of the invention of the limits of the appended claims.

What I claim is:

1. A drill pipe lifting and placement apparatus, comprising:

(a) a platform;

(b) an angularly disposable drilling frame having a longitudinal drilling frame axis and being pivotably connected to said platform for movement generally in a first plane and having means for holding a length of drill pipe;

(c) an angularly displaceable member pivotably connected to said platform for movement generally in a second plane generally parallel to and spaced from said first plane and having a longitudinal loading axis capable of being positioned parallel to said drilling frame axis and adjacent thereto for permitting transfer of drill pipe between said member and said frame;
(d) means for angularly displacing said member from a first position to a second position in substantial alignment with and substantially adjacent said holding means;
(e) drill pipe gripping means connected to said member;
(f) said gripping means rotatable about said longitudinal axis of said member from a first pre-determined position to a second pre-determined position substantially aligned with said holding means;
(g) means for rotating said gripping means; and,
(h) drive means associated with said gripping means for causing said gripping means to grip and release said drill pipe.

2. An apparatus as in claim 1, wherein:
(a) said holding means including a plurality of displaceable holding members.

3. An apparatus as in claim 1, further comprising:
(a) said gripping means including a plurality of gripper sets; and,
(b) each of said gripping sets including a pair of opposed cooperating associated jaws.

4. An apparatus as in claim 3, wherein
(a) said jaws mounted on a threaded rotatable shaft;
(b) each of said jaws having a threaded portion for mounting on said threaded shaft;
(c) said threaded portion of each jaw of a gripper set having a thread orientation opposed from said associated jaw thread orientation; and,
(d) motor means for rotating said threaded shaft for causing reciprocating displacement of said jaws.

5. An apparatus as in claim 1, wherein:
(a) said means for rotating said gripping means include motor means having an axis of rotation; and,
(b) said drill pipe gripping means axis of rotation co-axial with said motor axis.

6. An apparatus as in claim 5, further comprising:
(a) a bearing block connected to said displaceable member and having an aperture therethrouqh;
(b) a rotatable shaft co-axial with said motor axis and connected to said motor means;
(c) said rotatable shaft extending through said aperture and beyond said aperture; and,
(d) said gripping means extending from said rotatable shaft transverse of said shaft axis.

7. An apparatus as in claim 1, wherein
(a) said displaceable member includes a longitudinally extending shaft;
(b) means connected to said shaft and said platform for angularly displacing said shaft;
(c) a cylinder mount secured to said shaft;
(d) a pair of gripper means mounts secured to said shaft, said cylinder mount positioned between said gripper means mounts;
(e) a cylinder bracket pivotably secured to said cylinder mount;
(f) a pair of opposed co-axial rotatable shafts extending from said cylinder bracket and each of said rotatable shafts rotatably connected to one of said gripper means mounts;
(g) first and second spaced ears connected to said cylinder bracket;
(h) a cylinder having piston means, said cylinder pivotably secured to said first ear;
(i) a first contoured link pivotably connected to said piston means and said second ear;
(j) second and third contoured links pivotably connected to said piston means and said cylinder mount;
(k) a pair of pipe grippers, each of said pipe grippers connected to one of said rotatable shaft at said gripper means mounts and rotatable with said rotatable shafts; and,
(l) means for activating said piston means to cause said first contoured link and said second and said third contoured link to pivot to cause said cylinder bracket to rotate and thereby rotate said pair of said rotatable shafts to rotate said pipe grippers.

8. An apparatus as in claim 7, wherein;
(a) each of said grippers includes a gripper set;
(b) each gripper set including a pair of opposed cooperating associated jaws;
(c) each of said jaws of a gripper set mounted on a threaded rotatable shaft;
(d) each of said jaws having a threaded portion for mounting on said shaft;
(e) said threaded portion of each jaw of a gripper set having a thread orientation opposed from said associated jaw thread orientation; and,
(f) motor means connected to said threaded shaft for rotating said shaft to cause reciprocating displacement of said jaws.

9. An apparatus as in claim 1, wherein:
(a) said gripping means pre-determined second position being associated with said holding means whereby said drill pipes holding means support said length of said drill pipe in said second position.

10. An apparatus as in claim 8, further comprising:
(a) a plurality of drill pipe holding means reciprocatingly displaceable transverse of said frame.

11. An apparatus as in claim 10, further comprising:
(a) cylinder means connected to a first one of said pipe holding means and having piston means for reciprocatingly displacing said first one of said pipe holding means;
(b) a pipe holding means secured to said piston means and displaceable therewith;
(c) a pair of spaced parallel cooperating associated pipe jaws pivotably connected to said pipe holding means, said pipe holding means disposed between said pair of said pipe jaws;
(d) said pipe holding means having spaced first and second pin means extending therefrom;
(e) each of said pipe jaws having a slot therethrough for cooperating with said first pin means for guiding said pipe jaws;
(f) each of said pipe jaws having a channel for cooperating with said second pin means for guiding said pipe jaws;
(g) each of said pipe jaws having a pipe clamping portion and a jaw pivoting portion; and,
(h) cylinder means connected to each of said jaw pivoting portions and having piston means connected to said pipe holding means whereby reciprocating displacement of said piston means causes said pipe jaws to pivot from a pipe released to a pipe clamping position.

12. An apparatus as in claim 11, further comprising:
(a) cylinder means having piston means connected to a second one of said pipe holding means for reciprocating displacement of said second one of said pipe holding means; and, (b) cylinder means having piston means connected to a third one of said pipe holding means for reciprocant and displacement of said third one of said pipe holding means.

13. An apparatus as in claim 12, wherein:

(a) said pipe jaws and said pipe holding means being adapted for preventing the unintended displacement of said drill pipe.

14. An apparatus as in claim 7, wherein:

(a) said pair of rotatable shafts rotate substantially 270°.

15. An apparatus as in claim 10, further comprising:

(a) said pipe holding means each having a drill pipe supporting surface; and, (b) said drill pipe supporting surfaces being alignable.

16. An apparatus as in claim 1, wherein:

(a) a cylinder having piston means being connected to said platform and said frame for angularly disposing said frame to any angle between the horizontal and the vertical.

17. An apparatus as in claim 10, further comprising:

(a) a motor spindle displacably connected to said frame; and, (b) said spindle cooperating with said pipe holding means.

18. An apparatus as in claim 7, further comprising:

(a) each of said gripper means mounts including a pair of spaced parallel members each having a co-axial aperture therethrough;

(b) an auxiliary member disposed between each of said parallel means of said gripper means mounts and extending upwardly therefrom and having an aperture therethrough;

(c) a pair of links, one of said links connected to one of said parallel members of a gripper means mount and having first and second apertures therethrough and rotatable around said aperture of said parallel numbers;

(d) a third link rotatably mounted to said auxillary lary member aperture and said first aperture;

(e) a fourth link pivotably mounted to said second apertures and said first apertures; and, (f) said gripping means secured to said fourth link, whereby rotation of said rotatable shaft causes said pair of said links to rotate and said third link to rotate around said auxiliary member aperture to cause said fourth link to be angularly displaced and to rotate said gripping means.

19. A drill pipe lifting an placement apparatus, comprising:

(a) a platform;

(b) an angularly disposable frame pivotally connected to said platform and having means for holding a length of drill pipe;

(c) an angularly displaceable member pivotally connected to said platform;

(d) means for angularly displacing said member from a first position to a second position substantially adjacent said holding means;

(e) drill pipe gripping means connected to said member;

(f) said gripping means rotatable on an axis from a first position to a second position substantially aligned with said holding means;

(g) means for rotating said gripping means;

(h) drive means associated with said gripping means for causing said gripping means to grip and release drill pipe;

(i) said means for rotating said gripping means includes motor means having an axis of rotation;

(j) said drill pipe gripping means axis of rotation being coaxial with said motor axis;

(k) a bearing block connected to said displaceable member and having an aperture therethrough;

(l) a rotatable shaft coaxial with said motor axis being connected to said motor means;

(m) said rotatable shaft extending through said aperture and beyond said aperture; and, (n) said gripping means extending from said rotatable shaft transverse of said shaft axis.

* * * * *